US011724299B2

(12) United States Patent
Rave et al.

(10) Patent No.: US 11,724,299 B2
(45) Date of Patent: Aug. 15, 2023

(54) METHOD FOR STRAIGHTENING OF A FECRAL ALLOY TUBE

(71) Applicant: Sandvik Intellectual Property AB, Sandviken (SE)

(72) Inventors: Fernando Rave, Västerås (SE); Krister Wickman, Hallstahammar (SE); Thomas Froböse, Versmold (DE)

(73) Assignee: Sandvik Intellectual Property AB, Sandviken (SE)

( * ) Notice: Subject to any disclaimer, the term of this patent is extended or adjusted under 35 U.S.C. 154(b) by 258 days.

(21) Appl. No.: 16/958,175

(22) PCT Filed: Dec. 21, 2018

(86) PCT No.: PCT/EP2018/086767

§ 371 (c)(1),
(2) Date: Jun. 26, 2020

(87) PCT Pub. No.: WO2019/129747

PCT Pub. Date: Jul. 4, 2019

(65) Prior Publication Data

US 2020/0360978 A1 Nov. 19, 2020

(30) Foreign Application Priority Data

Dec. 27, 2017 (EP) ..... 17210696

(51) Int. Cl.
*B21D 3/12* (2006.01)
*C22C 38/28* (2006.01)
(Continued)

(52) U.S. Cl.
CPC ..... *B21D 3/12* (2013.01); *C21D 6/002* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS

2008/0210348 A1 9/2008 Goransson et al.

FOREIGN PATENT DOCUMENTS

CN 101637789 A 2/2010
CN 104862593 A * 8/2015
(Continued)

OTHER PUBLICATIONS

Yukinor Yamamoto, "Development and Quality Assessments of Commercial Heat Production of ATF FeCrAl Tubes", Oak Ridge National Laboratory, ORNL/TM-2015/478, Sep. 4, 2015.
(Continued)

*Primary Examiner* — Anthony M Liang
(74) *Attorney, Agent, or Firm* — Morgan, Lewis & Bockius LLP

(57) ABSTRACT

The present disclosure relates to a method for straightening of a tube comprising a ferritic FeCrAl-alloy. One reason for the challenges regarding the cold working of a hollow of a ferritic FeCrAl-alloy into a finished tube is that FeCrAl-alloys have a low ductility. Even if a tube of a FeCrAl-alloy is obtained by cold working a hollow into a tube, the tube can hardly be straightened. This is even more a problem if a tube obtained is annealed, wherein the annealing leads to a deformation of tube along the longitudinal direction of the tube. Therefore, there is a need for a method for straightening of a tube comprising a ferritic FeCrAl-alloy. Thus, according to the present disclosure a method for straightening of a tube is suggested, wherein the method comprises the steps of providing a tube comprising a ferritic FeCrAl-alloy, heating the tube, and straightening and forming the heated tube by stretching.

13 Claims, 2 Drawing Sheets

(51) Int. Cl.

| | |
|---|---|
| ***C22C 38/06*** | (2006.01) |
| ***C22C 38/04*** | (2006.01) |
| ***C22C 38/02*** | (2006.01) |
| ***C22C 38/00*** | (2006.01) |
| ***C22C 38/26*** | (2006.01) |
| ***C21D 9/08*** | (2006.01) |
| ***C21D 8/10*** | (2006.01) |
| ***C21D 6/00*** | (2006.01) |
| ***C22C 38/22*** | (2006.01) |
| *C21D 1/34* | (2006.01) |

(52) U.S. Cl.

CPC ..... *C21D 8/105* (2013.01); *C21D 9/08* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/26* (2013.01); *C22C 38/28* (2013.01); *C21D 1/34* (2013.01)

(56) References Cited

FOREIGN PATENT DOCUMENTS

| | | | | |
|---|---|---|---|---|
| CN | 106319369 | A | 1/2017 | |
| GB | 1035013 | A | 7/1966 | |
| JP | S55-78484 | A | 6/1980 | |
| JP | H04-99821 | A | 3/1992 | |
| JP | H06-226348 | A | 8/1994 | |
| JP | H07-76728 | A | 3/1995 | |
| JP | H09-228008 | A | 9/1997 | |
| JP | 2007-524001 | A | 8/2007 | |
| WO | WO-9607722 | A1 * | 3/1996 | ..... C10M 107/28 |

OTHER PUBLICATIONS

Communication pursuant to Article 94(3) EPC dated Sep. 24, 2021 in European Application No. 18826390.9.

Field et al., "Handbook on the Material Properties of FeCrAl Alloys for Nuclear Power Production Applications", Aug. 31, 2017 , Retrieved from the Internet: URL:https://info.ornl.gov/sites/publications/Files/Pub74128.pdf XP055474480 [retrieved on May 14, 2018].

International Search Report and Written Opinion issued in corresponding International Patent Application No. PCT/EP2018/086767, dated Feb. 14, 2019.

Office Action dated Nov. 8, 2022, issued in corresponding Japanese Patent Application No. 2020-535548.

Office Action dated May 9, 2023, issued in corresponding Korean Patent Application No. 10-2020-7018130.

Office Action dated May 30, 2023, issued in corresponding Japanese Patent Application No. 2020-535548.

* cited by examiner

METHOD FOR STRAIGHTENING OF A FECRAL ALLOY TUBE

TECHNICAL FIELD

The present disclosure relates to a method for straightening of a tube comprising a ferritic FeCrAl-alloy.

BACKGROUND

Cold working of a tube of a metal or a metal alloy leads to a strain hardening of the metal or metal alloy. In order to enhance the ductility again after the cold working process, the tube is typically annealed. This annealing enhances the ductility of the material but may lead to deformation of the shape of the tube in particular in a longitudinal direction. In order to still obtain a high quality product, the tube is, after annealing, often straightened in order to obtain a straight tube. Furthermore, straightening of a tube may be required even if the tube has not been cold worked or a cold worked tube after cold working has not been annealed.

FeCrAl-alloys provide a heat resistance up to approximately 1400° C. while at the same time providing an extraordinarily good form stability as well as resistance against corrosion.

While tubes of powder-metallurgical dispersion hardened ferritic FeCrAl-alloys are commercially available, hollows made of FeCrAl-alloys have been difficult to form into tubes. This is in particular problematic as the powder-metallurgical production has constraints regarding the dimensions of extruded tubes.

One reason for these problems relates to the cold working process as FeCrAl-alloys in general have low ductility. Thus, even if a tube of a FeCrAl-alloy is obtained by cold working, the obtained tube cannot be straightened. This is even more a problem if the obtained tube is annealed because the annealing process leads to the deformation of the tube along the longitudinal axis of the tube.

There is therefore need for a method for straightening of a tube comprising a ferritic FeCrAl-alloy when the tube has been manufactured by cold working.

SUMMARY

According to the present disclosure a method for straightening of a tube is provided, wherein the method comprises the steps of providing a tube comprising a ferritic FeCrAl-alloy, heating the tube, and straightening and forming the heated tube by stretching. A FeCrAl is an alloy which always comprises iron (Fe), chromium (Cr) and aluminium (Al). The content of Aluminium is above 2 weight %.

Surprisingly, it has been found that an efficient straightening of a tube comprising a ferritic FeCrAl-alloy will be achieved if the FeCrAl containing tube is heated during stretching, i.e. a heated tube is stretched.

In an embodiment of the present disclosure, the stretching is a stretch forming process.

In a further embodiment of the present disclosure, the heated tube is irreversibly stretched in a longitudinal direction of the tube. By the term "irreversible stretching" is meant that the stretching is at least not entirely elastic, i.e. after stretching the tube does not return into the shape and/or length it had before stretching.

In an embodiment of the present disclosure, during the step of straightening and forming the tube is mounted at a first end of the tube and/or at the second end of the tube, wherein at least the first end and/or the second end of the tube is pulled with a preset force. A preset force may also be denoted as a defined force. In an embodiment, the preset force is kept constant over a preset period of time. In an embodiment, the preset force is varied over a preset period of time.

While in an embodiment, the tube may be pulled at both ends of the tube, according to another embodiment, the tube during the step of straightening and forming is pulled at only one end.

According to one embodiment, the heating of the tube is to be carried out prior to the stretching, such that the tube is stretched at an increased temperature, i.e. at a temperature which is above room temperature. According to another embodiment, the tube is heated at least simultaneously or simultaneously during the stretching. According to another embodiment, the tube is heated both prior and during the stretching. In another embodiment, the heating of the tube is carried out prior to, during and after the stretching.

In order to heat the tube, there are alternative techniques which may be applied. In an embodiment of the present disclosure, the tube is heated in a furnace. In another embodiment, the heating is effected by induction In yet another embodiment according to the present disclosure, an electric current is applied to the tube during the stretching in order to heat the tube. The current is passed through the tube. (In an embodiment of the present disclosure, in order to apply the electric current to the tube, a first end of the tube and a second end of the tube are electrically connected to an electrical power source.

In an embodiment, the tube is heated so that the tube during the stretching has a temperature range from about 100° C. to about 1400° C., such as from 100 to 1200° C., such as from 100 to 1150° C., such as from 100 to 1100° C., such as from 100 to 1000° C., such as from 100 to 500° C., such as from 100 to 200° C.

Although the stretching is carried out while the tube has an increased temperature, the stretching of the tube is still considered a cold working process. In the present disclosure, a working process is denoted a cold working process as long as it is carried out below the recrystallization temperature of the alloy to be worked. Cold working in the sense of the present disclosure includes cold pilgering or cold drawing or cold stretching.

Any value specified in the present disclosure by the term "about" is considered to be defined by +1-10% of the value given.

According to one embodiment of the present disclosure, the ferritic FeCrAl alloy comprises in weight % (wt %):

Cr 9-25;

Al 3 to 7;

Balance Fe and unavoidable impurities.

In an embodiment of the present disclosure the ferritic FeCrAl-alloy of the tube comprises, in wt-%: Cr 9 to 25; Al 3 to 7; Mo 0 to 5; C 0 to 0.08; Si 0 to 3.0; Mn 0 to 0.5; balance Fe; and normally occurring impurities.

In other embodiment, the FeCrAl alloy may also comprise the following elements:

Y 0.05 to 0.60; Zr 0.01 to 0.30; Hf 0.05 to 0.50; Ta 0.05 to 0.50; Ti 0 to 0.10; C 0.01 to 0.05; N 0.01 to 0.06; O 0.02 to 0.10; Si 0.10 to 3.0; Mn 0.05 to 0.50; P 0 to 0.03; and S 0 to 0.03.

In yet another embodiment of the present disclosure, the ferritic FeCrAl-alloy may further comprise, in wt-%: C 0.01 to 0.05; N 0.01 to 0.06; O 0.02 to 0.10; Mn 0.05 to 0.50; P 0 to 0.80; S 0 to 0.005; balance Fe; and normally occurring impurities. In a further embodiment of the present disclosure, the content of Mo higher than 0 wt-%.

In yet another embodiment of the present disclosure, the ferritic FeCrAl-alloy comprises, in wt-%: Cr 9 to 25; Al 3 to 7; Mo 0 to 5; Y 0.05 to 0.60; Zr 0.01 to 0.30; Hf 0.05 to 0.50; Ta 0.05 to 0.50; Ti 0 to 0.10; C 0.01 to 0.05; N 0.01 to 0.06; O 0.02 to 0.10; Si 0.10 to 3.0; Mn 0.05 to 0.50; P 0 to 0.80; S 0 to 0.005; balance Fe; and normally occurring impurities. In a further embodiment of the present disclosure, the content of Mo, Ti, P, and S is larger than 0 wt-% in this ferritic FeCrAl-alloy.

In a further embodiment of the present disclosure, the content of Mo, C, Si, and Mn is larger than 0 wt-%.

The term "impurities" as referred to herein is intended to denote substances that will contaminate the FeCrAl-alloy when it is industrially produced, due to the raw materials such as ores and scraps, and due to various other factors in the production process, and are allowed to contaminate within the ranges not adversely affecting the ferritic FeCrAl-alloy as defined hereinabove or hereinafter.

In the above embodiments, the compositions of the FeCrAl-alloy may further comprise additional elements or substances in concentrations, wherein these elements or substances do not change the specific properties of the FeCrAl-alloy as outlined in the present disclosure. In this case the term "balance Fe" denotes the balance to 100% in addition to mandatory elements according to the embodiments plus optional elements or substances.

Alloys falling into anyone of the above specifications are characterized by an extraordinary heat resistance, form stability as well as resistance against corrosion.

Examples but not limiting to applications for tubes comprising ferritic FeCrAl-alloys are high-temperature furnaces for firing of ceramics, annealing furnaces and furnaces for the electronics industry.

According to another aspect of the present disclosure, a method for manufacturing a tube comprising a ferritic FeCrAl-alloy is provided, wherein the method comprises the steps in the following order: providing a hollow comprising a ferritic FeCrAl-alloy, cold working the hollow into the tube, annealing the tube, and straightening the tube using a method for straightening of a tube as it is described hereinabove or hereinafter.

Cold working of the hollow into the tube below the recrystallization temperature of the ferritic FeCrAl-alloy leads to a strain hardening of the material of the tube. In order to enhance the ductility of the material of the tube again, the tube is annealed before straightening thereof. In an embodiment of the present disclosure, the tube is annealed at a temperature in a range from about 700° C. to about 1150° C.

Tubular hollows of a ferritic FeCrAl-alloy are very difficult to cold work into tubes, especially tubes of small dimensions by using pilgering or drawing at room temperature because of low ductility of the FeCrAL-alloy. Attempts performed in prior art have led to a destruction of the hollow. Surprisingly, it has been found that a hollow comprising a ferritic FeCrAl-alloy can be worked into a tube using the techniques known as cold forming or cold working or cold strengthening, when the hollow immediately before or during its infeed into the cold working equipment is heated to a temperature range from about 90° C. to about 600° C., such as from about 90 to 400° C., such as from about 90 to 150° C. Expressed in other words, the hollow when or during coming into engagement with the cold working equipment is at a temperature in a range as mentioned above. It has surprisingly been shown that having the FeCrAl alloy in this temperature range will avoid destruction of the hollow during the cold working process while still being cold enough in order to use conventional lubricants typically used for cold working.

In an embodiment, the tube may be cladding tube for a nuclear fuel rod.

The present method as defined hereinabove or hereinafter may be used, without being limited to, for manufacturing tubes comprising a FeCrAl alloy having an outer diameter of less than 26 mm and/or an inner diameter of less than 6.7 mm. However, tubes having higher inner and outer dimensions may also be manufactured with the present method.

BRIEF DESCRIPTION OF THE FIGURES

Further advantages, features and applications of the present disclosure will become apparent from the following description of embodiments and the corresponding figures attached. The foregoing as well as the following detailed description of the embodiments will be better understood when read in conjunction with the appendant drawings. It should be understood that the embodiments depicted are not limited to the precise arrangements and instrumentalities shown.

DETAILED DESCRIPTION

Figure 1:
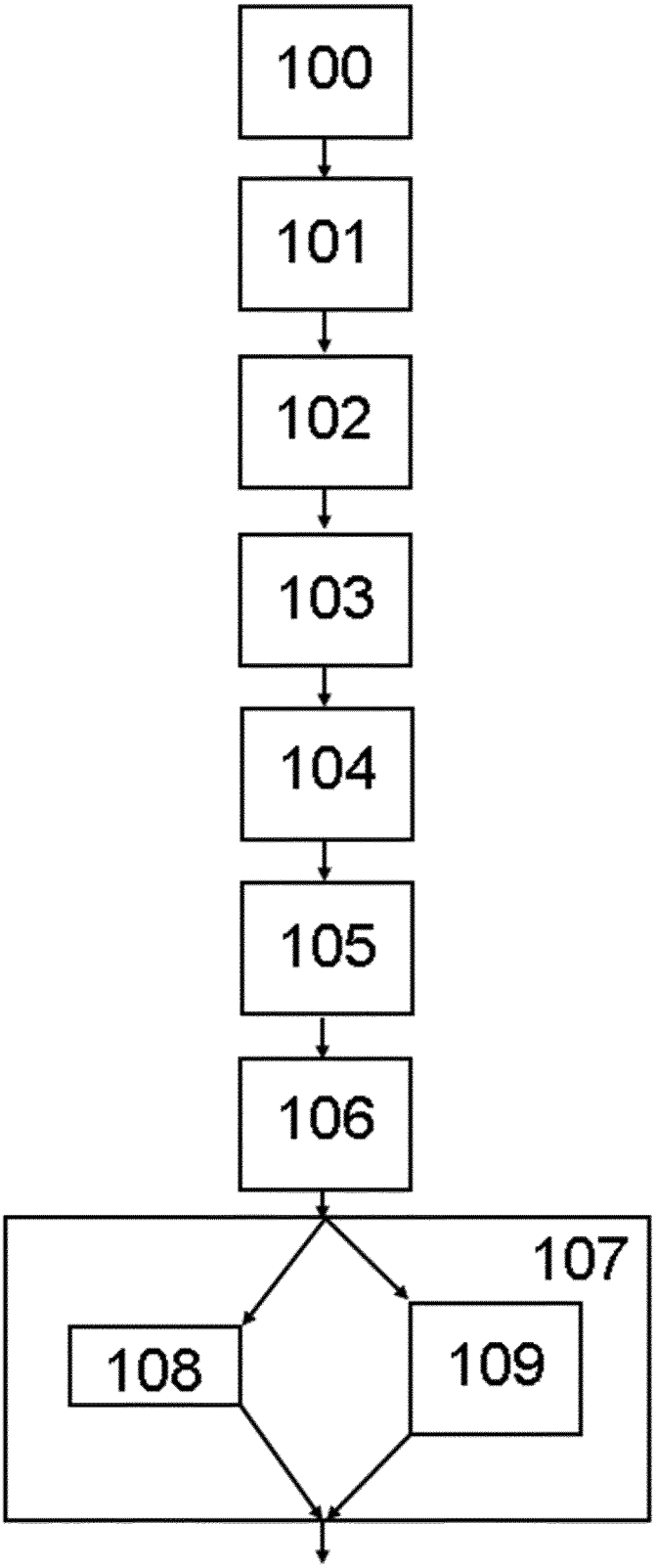
FIG. 1 is a schematic flow chart of a method for manufacturing a tube according to the present disclosure.

FIG. 1 is a flow chart exemplarily describing a method for manufacturing a tube according to an implementation of the present disclosure. In a first step 100, a hollow of a FeCrAl-alloy is provided.

In the example depicted in the flow chart of FIG. 1, the hollow provided in step 100 in step 101 is glass-blasted on its inner surface, only. By glass-blasting the inner surface, any corrosion on the inner surface is ablated enhancing the properties of the finished tube. Surprisingly, a blasting of the hollow on its outer surface does not further enhance the properties of the finished tube.

After blasting, the hollow in step 102 is immersed into a water-based polymer suspension. By immersing the hollow into the polymer suspension, the polymer suspension coats the hollow. After drying of the hollow in warm air in step 103, the polymer contained in the polymer suspension coats the entire hollow as a film and serves as a lubricant for the hollow during the cold working thereof into a tube.

After the coating has been dried, the coated hollow is fed into a drawing bench in order to cold work the hollow into a tube. The hollow in step 104 is heated to a temperature of 125° C., wherein the temperature is measured right before the tube enters the forming zone defined by the drawing die and the mandrel. Finally, the hollow is drawn in step 105 through the gap defined by the drawing die and the mandrel. Simultaneously with the drawing of the hollow into the tube, a lubricant is applied to the outer surface of the hollow.

The cold working process, i.e. the drawing of the hollow through the gap defined by the drawing die and the mandrel, not only reduces and defines the dimensions of the tube, but the cold working below the recrystallization temperature of the FeCrAl-alloy leads to a strain hardening of the material of the tube. In order to enhance the ductility of the material the tube in step 106 is annealed at a temperature in a range from about 700° C. to about 1150° C., wherein the exact temperature will depend on the microstructure of the FeCrAl-alloy.

Figure 2:
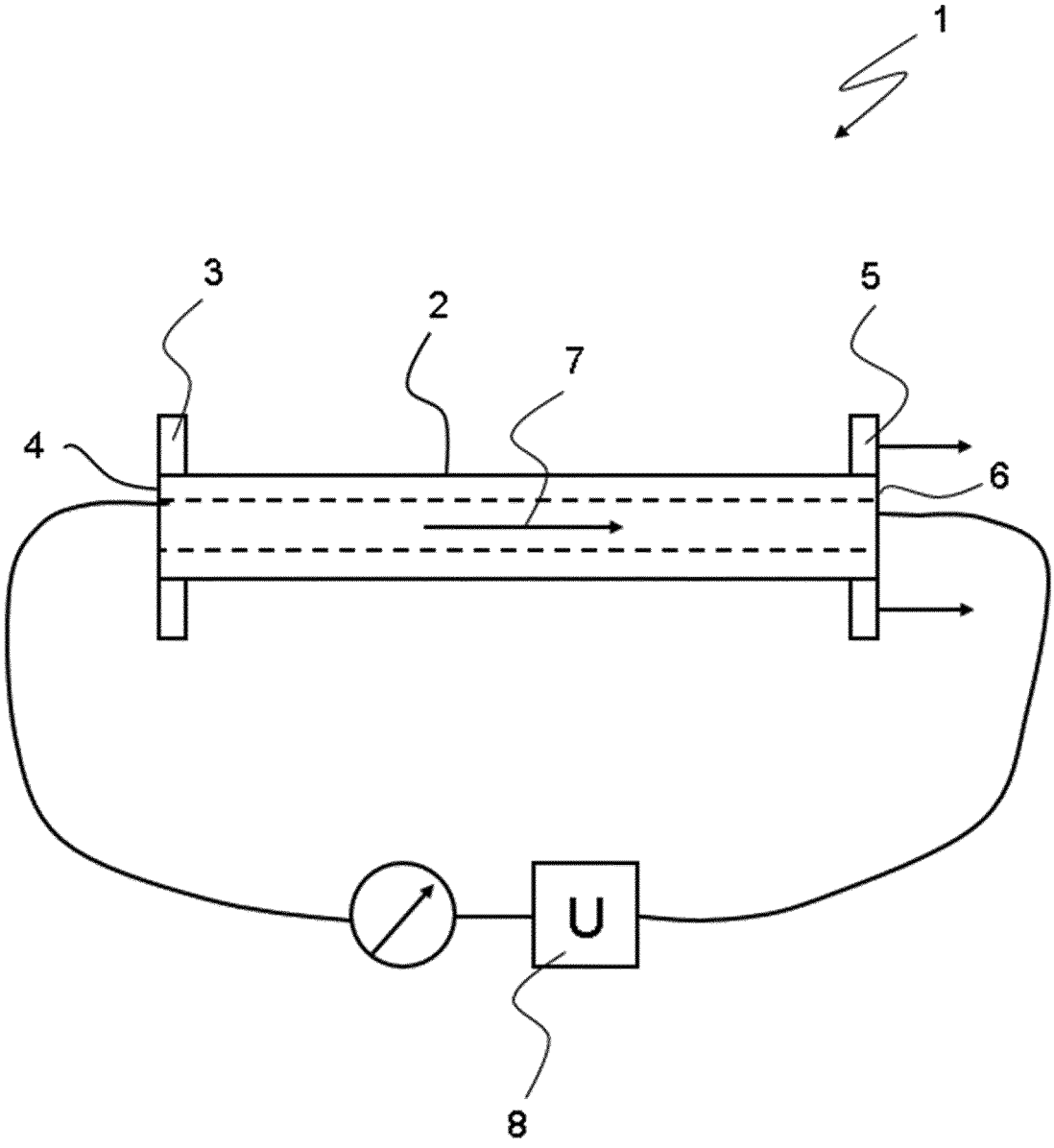
FIG. 2 is a schematic side view of an apparatus with a tube for stretching this tube for straightening and forming of the tube.

After annealing and cooling to a temperature around room temperature the tube is no longer straight in a longitudinal direction of the tube. In order to straighten and form the tube after annealing, the tube is inserted into a stretching equipment as it is schematically depicted in FIG. 2. In step 107 the tube is then simultaneously heated and stretched as schematically depicted in FIG. 1. The stretching is denoted by reference number 108, wherein the heating is denoted by reference number 109. What is important is that before the stretching 108 can start the tube must have reached a temperature range from 100° C. to 1400° C., such that the tube is in a heated state during the stretching. In this particular implementation heating is carried during the stretching. However, generally it is sufficient to stretch the tube at the increased temperature. Thus, in an implementation of the present disclosure, the tube is heated prior to the stretching only.

In order to enable heating and stretching simultaneously, the apparatus 1 for stretching the tube 2 has a first clamping means 3 at a first end 4 of the tube 2. This first clamping mechanism 3 is in a fixed position relative to a baseplate of the apparatus 1. A second clamping means 5 is provided at a second end 6 of the tube 2. In contrast to the fixed clamping means 3 the second clamping means 5 is movable in a longitudinal direction 7 of the tube 2, wherein a distance between the fixed clamping means 3 and the second clamping means 5 is enlarged. By applying a preset force during the pulling of the second clamping means 5 the tube 2 is stretched.

In order to heat the tube 2 to a preset temperature in the given range which is then held during the actual stretching, the first end 4 and the second end 6 of the tube 2 are connected to a voltage source 8 applying a voltage across the tube such that a current will flow through the tube 2, wherein the resistance within the tube 2 leads to a heating of the tube 2.

For purposes of the original disclosure, it is noted that all features become apparent to a person skilled in the art from the present description, the figures and the claims even if they have only been described with reference to particular further features and can be combined either on their own or in arbitrary combinations with other features or groups of features disclosed herein as far as such combinations are not explicitly excluded or technical facts exclude such combinations or make them useless. An extensive, explicit description of each possible combination of features has only been omitted in order to provide a short and readable description.

While the disclosure has been shown in detail in the figures and the above description, this description is only an example and is not considered to restrict the scope of protection as it is defined by the claims. The disclosure is not restricted to the disclosed embodiments.

Modifications to the disclosed embodiments are apparent for a person skilled in the art from the drawings, the description and the attached claims. In the claims, the word "comprising" does not exclude other elements or steps and the undefined article "a" does not exclude a plurality. The mere fact that some features have been claimed in different claims does not exclude their combination. Reference numbers in the claims are not considered to restrict the scope of protection.

REFERENCE NUMERALS

1 Apparatus
2 Tube
3 First clamping means (fixed)
4 First end of the tube 2
5 Second clamping means
6 Second end of the tube 2
7 Longitudinal direction
8 Current source
100 Providing the hollow
101 Glass blasting the hollow
102 Coating the hollow
103 Drying the coating
104 Heating
105 Drawing
106 Annealing
107 Straightening and forming
108 Stretching
109 Heating

The invention claimed is:

1. A method for manufacturing a tube, comprising the steps in the following order:
providing a hollow comprising a ferritic FeCrAl-alloy;
heating the hollow to a temperature below a recrystallization temperature of the ferritic FeCrAl-alloy;
cold working the heated hollow into the tube;
annealing the cold worked tube; and
straightening the annealed tube using a straightening method including the steps of:
heating the tube, and
straightening and forming the heated tube by stretching,
wherein the hollow, during cold working, has a temperature in a range from about 90° C. to about 600° C.,
wherein cold working the heated hollow into the tube is pilgering or drawing, and
wherein the ferritic FeCrAl-alloy comprises, in wt-%:
Cr 9 to 25,
Al 3 to 7,
balance Fe, and
normally occurring impurities.

2. The method according to claim 1, wherein the heated tube is irreversibly stretched in a longitudinal direction of the tube.

3. The method according to claim 1, wherein during the step of straightening and forming, the tube is mounted at a first end of the tube and/or at a second end of the tube, and wherein at least the first end and/or the second end of the tube is pulled with a preset force.

4. The method according to claim 1, wherein during straightening and forming an electric voltage is applied to the tube, in order to heat the tube by an electric current flowing through the tube.

5. The method according to claim 1, wherein the tube is heated so that the tube during straightening and forming has a temperature in a range from about 100° C. to about 1400° C.

6. The method according to claim 1,
wherein, during the step of straightening and forming, the tube is mounted at a first end of the tube and/or at a second end of the tube, and wherein at least the first end and/or the second end of the tube is pulled with a preset force,
wherein, during the step of straightening and forming, the heated tube is irreversibly stretched in a longitudinal direction of the tube,
wherein, during the step of straightening and forming, an electric voltage is applied to the tube, in order to heat the tube by an electric current flowing through the tube, and wherein heating the tube results in the tube having a temperature in a range from about 100° C. to about 1400° C. during the step of straightening and forming.

7. The method according to claim 1, wherein the temperature below the recrystallization temperature is 90° C. to 600° C.

8. The method according to claim 1, further comprising:

before cold working the heated hollow into the tube, coating the hollow with a water-based polymer suspension.

9. The method according to claim 1, wherein, before heating the coated hollow to the temperature below the recrystallization temperature of the ferritic FeCrAl-alloy and cold working the heated hollow into the tube, the method further comprises:

coating the hollow with a water-based polymer suspension, and drying the coating.

10. The method according to claim 9, wherein the temperature below the recrystallization temperature is 90° C. to 600° C.

11. The method according to claim 1, wherein annealing the cold worked tube is at a temperature of 700° C. to 1150° C.

12. The method according to claim 1, wherein the ferritic FeCrAl-alloy comprises, in wt-%:

Cr 9 to 25,
Al 3 to 7,
Mo >0 to 5,
C 0.01 to 0.05,
N 0.01 to 0.06,
O 0.02 to 0.10,
Mn 0.05 to 0.50,
P 0 to 0.80,
S 0 to 0.005,
Si 0 to 3.0,
balance Fe, and
normally occurring impurities.

13. The method according to claim 12, wherein the ferritic FeCrAl-alloy further comprises, in wt-%:

Y 0.05 to 0.60,
Z 0.01 to 0.30,
Hf 0.05 to 0.50,
Ta 0.05 to 0.50, and
Ti 0 to 0.10.

* * * * *